US010512135B2

(12) United States Patent
Harada et al.

(10) Patent No.: US 10,512,135 B2
(45) Date of Patent: Dec. 17, 2019

(54) CONTROL DEVICE, LIGHTING DEVICE, AND ILLUMINATION SYSTEM

(71) Applicant: Panasonic Intellectual Property Management Co., Ltd., Osaka (JP)

(72) Inventors: Kazuki Harada, Osaka (JP); Kentaro Yamauchi, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/192,376

(22) Filed: Nov. 15, 2018

(65) Prior Publication Data

US 2019/0159317 A1 May 23, 2019

(30) Foreign Application Priority Data

Nov. 20, 2017 (JP) ..... 2017-222936

(51) Int. Cl.
*H05B 37/02* (2006.01)
*H05B 33/08* (2006.01)
(Continued)

(52) U.S. Cl.
CPC ..... *H05B 33/0869* (2013.01); *H05B 33/083* (2013.01); *H05B 33/0863* (2013.01);
(Continued)

(58) Field of Classification Search
CPC ..... F21Y 2115/10; F21Y 2113/13; F21Y 2105/10; F21Y 2105/12; F21Y 2113/00; F21Y 2115/15; H05B 33/086; H05B 33/0869; H05B 33/0863; H05B 33/0857; H05B 37/02; H05B 33/0872; H05B 33/0815; H05B 33/0866; H05B 33/0803; H05B 33/0842; H05B 33/0845;
(Continued)

(56) References Cited

U.S. PATENT DOCUMENTS 7,002,546 B1 * 2/2006 Stuppi ..... G09G 3/3413 345/102
7,354,172 B2 * 4/2008 Chemel ..... H05B 33/0842 362/231
(Continued)

FOREIGN PATENT DOCUMENTS

JP H04-121773 A 4/1992
JP H04-121774 A 4/1992
(Continued)

*Primary Examiner* — Vibol Tan
(74) *Attorney, Agent, or Firm* — McDermott Will & Emery LLP

(57) ABSTRACT

A control device controls an illumination device that illuminates a surrounding area, and an effect-producing device that emits light producing an effect on the surrounding area. The control device includes a control unit that controls at least one of a color of first light emitted by the illumination device and a color of second light emitted by the effect-producing device so that at least one of the color of the first light and the color of the second light moves into a specified chromaticity range, the color of the first light and the color of the second light being outside of the specified chromaticity range. Colors in the specified chromaticity range are recognized as a same color by a human.

21 Claims, 7 Drawing Sheets

(51) Int. Cl.
*F21V 7/24* (2018.01)
*F21V 3/00* (2015.01)
*F21W 121/00* (2006.01)

(52) U.S. Cl.
CPC ..... *H05B 33/0896* (2013.01); *F21V 3/00* (2013.01); *F21V 7/24* (2018.02); *F21W 2121/008* (2013.01)

(58) Field of Classification Search
CPC ... H05B 37/0245; H05B 33/0854; F21K 9/64; F21K 9/00; F21S 8/04; F21S 8/00; F21S 10/023; F21S 8/026; G02B 6/0021; G02B 6/0073; G02B 6/0055; G02B 6/0031; G02B 6/00; G02B 6/0083; G02B 6/0091; F21V 3/00; F21V 3/0625; F21V 5/007; F21V 7/22; F21V 9/30; F21V 7/00; F21V 7/24; F21W 2121/008
See application file for complete search history.

(56) References Cited

U.S. PATENT DOCUMENTS 8,870,617 B2 * 10/2014 Harbers ..... H05B 33/0857 445/24
9,062,851 B2 * 6/2015 Matsubayashi .... C09K 11/7774
9,144,136 B2 * 9/2015 Hong ..... H05B 33/0869
9,163,790 B2 * 10/2015 Ogata ..... H05B 33/086
9,198,251 B2 * 11/2015 Ter Weeme ..... H05B 33/0863
9,426,863 B2 * 8/2016 Harbers ..... H05B 33/0857
9,526,143 B1 * 12/2016 Petluri ..... H05B 33/0863
9,585,224 B2 * 2/2017 Harbers ..... H05B 33/0857
9,609,715 B1 * 3/2017 Petluri ..... H05B 33/0845
9,781,808 B2 * 10/2017 Jorgensen ..... H05B 37/02
10,008,481 B2 * 6/2018 Yamauchi ..... H01L 25/0753
10,054,272 B2 * 8/2018 Fieberg ..... H05B 33/0857
2013/0342132 A1 * 12/2013 Jorgensen ..... H05B 37/02 315/297
2019/0029092 A1 * 1/2019 Petluri ..... H05B 33/0857
2019/0098720 A1 * 3/2019 Petluri ..... H05B 33/0857

FOREIGN PATENT DOCUMENTS

JP H04-121775 A 4/1992
JP H04-121776 A 4/1992
JP H04-121777 A 4/1992
JP H04-121778 A 4/1992
JP H04-121779 A 4/1992
JP H04-212035 A 8/1992
JP H11-144510 A 5/1999
JP 2001-134173 A 5/2001

* cited by examiner

CONTROL DEVICE, LIGHTING DEVICE, AND ILLUMINATION SYSTEM

CROSS REFERENCE TO RELATED APPLICATION

This application claims the benefit of priority of Japanese Patent Application Number 2017-222936 filed on Nov. 20, 2017, the entire content of which is hereby incorporated by reference.

BACKGROUND

1. Technical Field

The present disclosure relates to control devices, lighting devices, and illumination systems.

2. Description of the Related Art

An atmospheric lighting mechanism for artificial sky is disclosed which includes illumination units that automatically dim and an effect-producing spotlight that performs atmospheric lighting, and which controls the luminance of the effect-producing spotlight (see, for example, Patent Literature (PTL) 1 (Japanese Unexamined Patent Application Publication No. 4-121775)). The effect-producing spotlight is covered with a red filter, a blue filter, and a white filter, and emits red light, blue light, and white light.

SUMMARY

In such an atmospheric lighting mechanism for artificial sky, a color difference between a color of light emitted by the illumination units and a color of light emitted by the effect-producing spotlight produces a color contrast effect that makes a user see a color different from an actual color. As a result, the user feels discomfort.

In view of this, the present disclosure has an object to provide a control device, a lighting device, and an illumination system that can ease the discomfort of a user caused by a color difference, by reducing a color contrast effect.

In order to achieve the above object, a control device according to one aspect of the present disclosure is a controller that controls an illumination device that illuminates a surrounding area, and an effect-producing device that emits light producing an effect on the surrounding area. The controller controls at least one of a color of first light emitted by the illumination device and a color of second light emitted by the effect-producing device so that at least one of the color of the first light and the color of the second light moves into a specified chromaticity range, the color of the first light and the color of the second light being outside of the specified chromaticity range. Colors in the specified chromaticity range are recognized as a same color by a human Moreover, a lighting device according to one aspect of the present disclosure includes the above controller and a light source that emits light, serving as the illumination device or the effect-producing device.

Moreover, an illumination system according to one aspect of the present disclosure includes an illumination device, an effect-producing device, and the above controller that controls the illumination device and the effect-producing device.

According to the present disclosure, it is possible to ease the discomfort of a user caused by a color difference, by reducing a color contrast effect.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

[Overview]

When different complementary colors are arranged next to each other, people are generally subjected to complementary contrast. Complementary contrast means that when different complementary colors are arranged next to each other, the different complementary colors mutually emphasize chroma and thereby appear more vividly. For example, when a user sees blue light emitted by an effect-producing device and white light emitted by an illumination device that are next to each other, the white light of the illumination device appears orange in color to the user. In other words, the white light of the illumination device appears light having a lower color temperature than in reality, or the blue light of the effect-producing device appears light having a higher color temperature than in reality. This brings discomfort to the user.

In view of the above, the present disclosure makes it possible to ease the discomfort of a user caused by a color difference, by reducing a color contrast effect.

Hereinafter, embodiments of the present disclosure will be described with reference to the drawings. It should be noted that each of the subsequently described embodiments shows a specific example of the present disclosure. Accordingly, numerical values, shapes, materials, structural components, the arrangement and connection of the structure components, steps, the order of the steps, etc. indicated in the following embodiments are mere examples, and are not intended to limit the scope of the present disclosure. Therefore, among the structural components in the following embodiments, those not recited in any one of the independent claims which indicate the broadest concepts of the present disclosure are described as optional structural components.

Furthermore, the expression "substantially . . . ," described here using "substantially rectangular" as an example, is intended to include not only something that is exactly rectangular but also something that is acknowledged to be substantially rectangular.

It should be noted that the figures are schematic diagrams and are not necessarily precise illustrations. Moreover, in the figures, substantially identical components are assigned the same reference signs, and overlapping description thereof may be omitted or simplified.

The following describes a control device, a lighting device, and an illumination system according to each embodiment of the present disclosure.

Embodiment 1

[Configuration]

Figure 1:
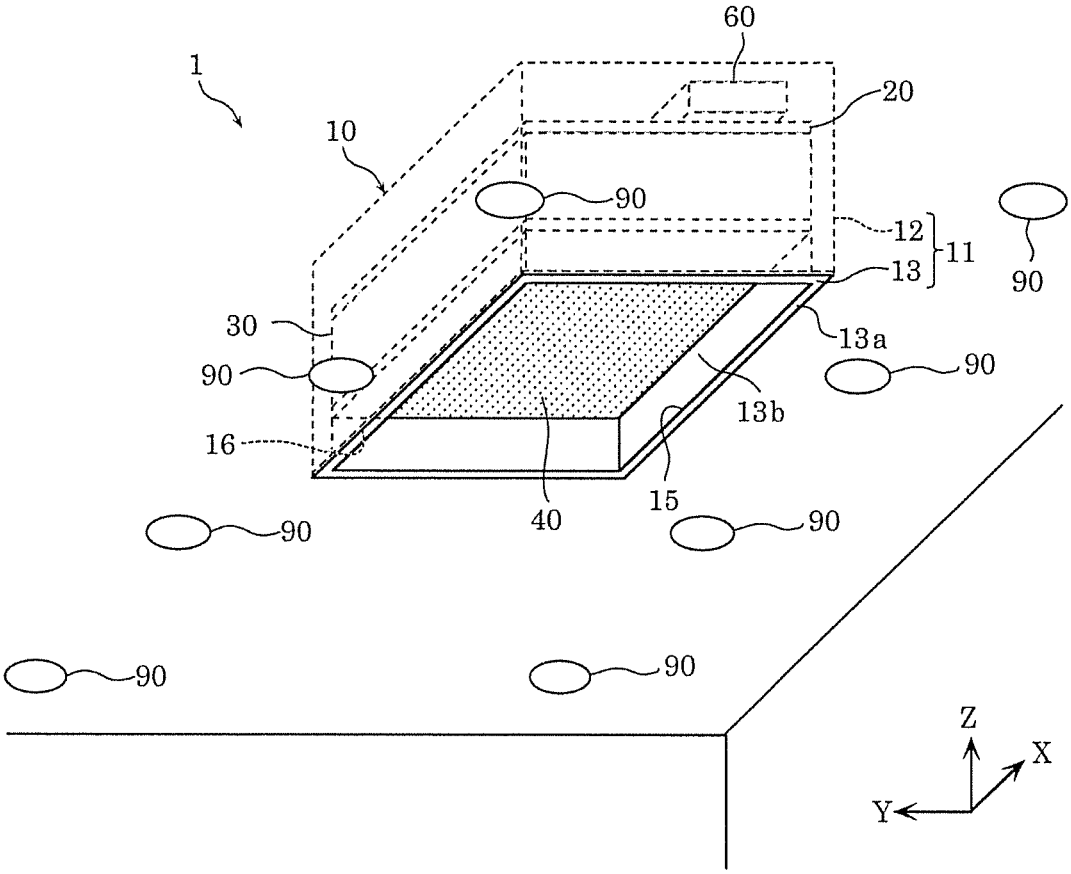
FIG. 1 is a diagram illustrating an illumination system according to Embodiment 1.
Figure 2:
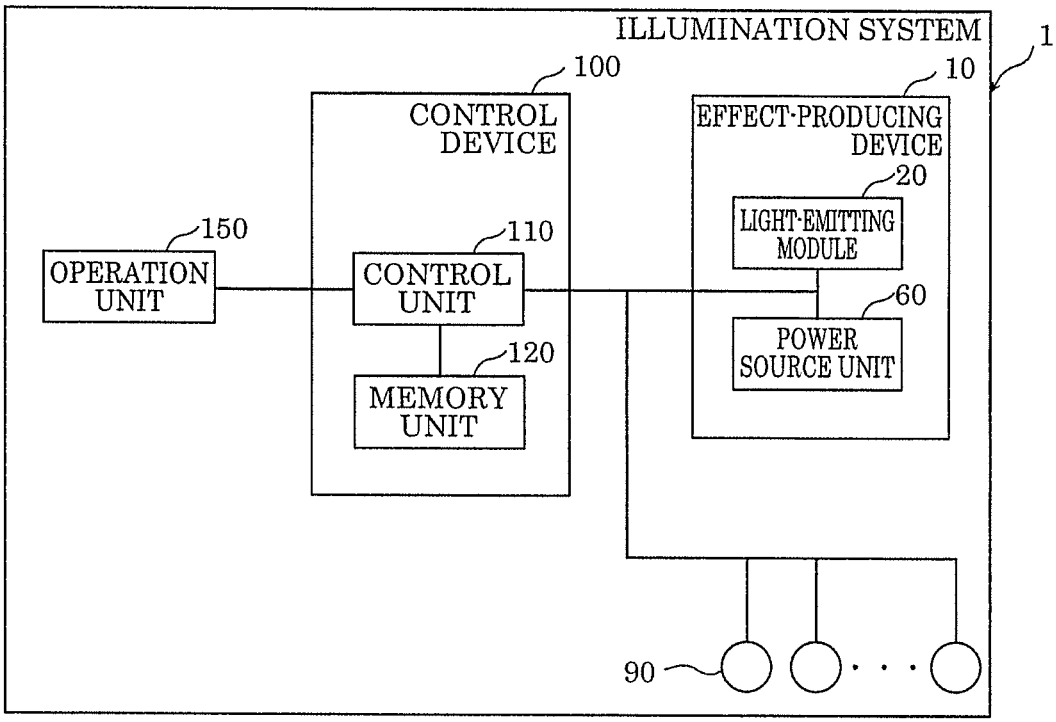
FIG. 2 is a block diagram illustrating the illumination system according to Embodiment 1.
Figure 3:
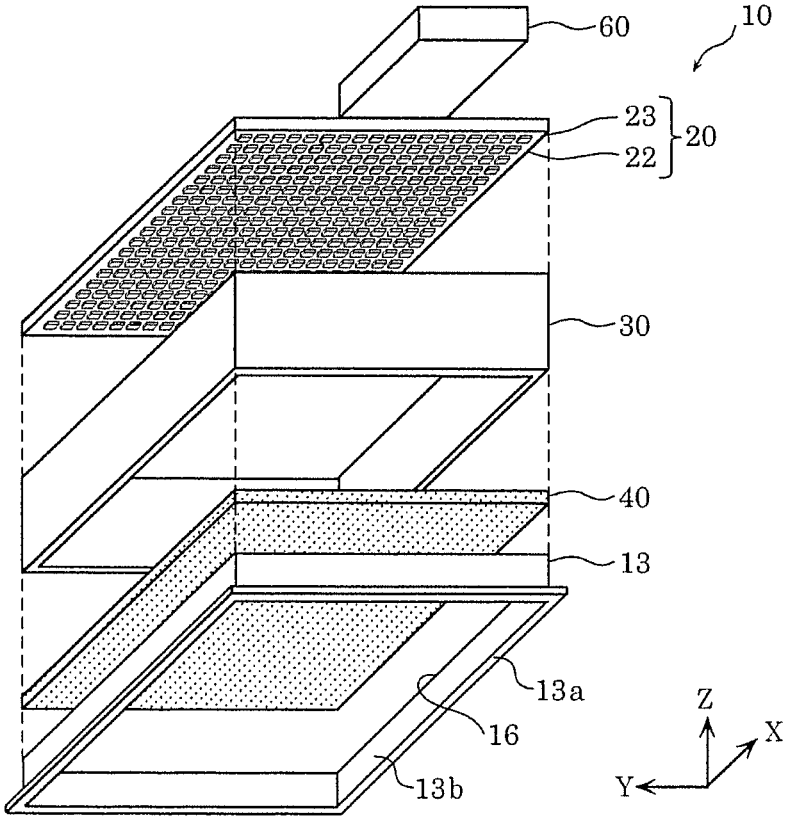
FIG. 3 is an exploded perspective view of an effect-producing device of the illumination system according to Embodiment 1.

FIG. 1 is a diagram illustrating illumination system 1 according to Embodiment 1. FIG. 2 is a block diagram illustrating illumination system 1 according to Embodiment 1. FIG. 3 is an exploded perspective view of effect-producing device 10 of illumination system 1 according to Embodiment 1. In FIG. 3, housing portion 12 is left out.

The X axis, the Y axis, and the Z axis in FIG. 1 are respectively defined as the longitudinal direction of effect-producing device 10 in a plan view of effect-producing device 10, an arrangement direction of, for example, light reflector 30 and light diffuser 40, and a direction orthogonal to the X axis and the Z axis. The directions illustrated in FIG. 1 correspond to the directions illustrated in FIG. 3.

As shown in FIG. 1, illumination system 1 according to Embodiment 1 allows a user to experience a virtual sensation that the user looks at the sky through an indoor window. For example, illumination system 1 is a system that is installed indoors and artificially produces light simulating a natural sky, such as a blue sky, a cloudy sky, and a sky at sunset, through an indoor window.

As shown in FIG. 1 and FIG. 2, illumination system 1 includes illumination devices 90 that illuminate a surrounding area, effect-producing device 10 that emits light producing an effect on the surrounding area, control device (controller) 100, and operation unit 150. In Embodiment 1, one effect-producing device 10 and illumination devices 90 of illumination system 1 are disposed in a part of a building such as a ceiling.

[Effect-Producing Device]

Effect-producing device 10 can artificially produce light simulating a natural sky such as a blue sky, a cloudy sky, and a sky at sunset. Effect-producing device 10 displays an image simulating a changing state of a natural sky such as a blue sky, a cloudy sky, and a sky at sunset. Effect-producing device 10 can illuminate a surrounding area with the light of the image simulating the natural sky. Effect-producing device 10 is connected to control device 100, and the operations of effect-producing device 10, such as turning on light, turning off light, dimming, and toning, are controlled by control device 100. Effect-producing device 10 is a luminaire, a projector, etc. The term image here is a moving image but may be a still image. Effect-producing device 10 is an example of a lighting device.

Effect-producing device 10 can emit light having a chromatic color such as red light, blue light, yellow light, and orange light, and light having an achromatic color such as white light. Effect-producing device 10 is not limited to light having a chromatic color, and can also emit light in a predetermined color temperature range along a black body locus.

As shown in FIG. 1 to FIG. 3, effect-producing device 10 includes case 11, light-emitting module 20, light reflector 30, light diffuser 40, and power source unit 60. Power source unit 60, light-emitting module 20, light reflector 30, light diffuser 40, and frame portion 13 of case 11 are disposed in listed order from the positive side of the Z axis toward the negative side of the Z axis. The positive side of the Z axis is a ceiling side, and the negative side of the Z axis is a floor side.

Case 11 is a case body that houses light-emitting module 20, light reflector 30, light diffuser 40, and power source unit 60. Case 11 is a flat box body, having a substantially rectangular shape in a plan view. It should be noted that case 11 is not limited to the substantially rectangular shape, and may have a shape such as a substantially circular shape, a substantially polygonal shape, and a substantially semicircular shape. The shape is not particularly limited.

Case 11 includes, for example, a metal material or a non-metal material having high thermal conductivity. Examples of the non-metal material having high thermal conductivity include a resin having a high rate of thermal conductivity. Use of a material having high thermal conductivity for case 11 allows heat generated by light-emitting module 20 to be dissipated to the outside via case 11. It should be noted that housing portion 12 and frame portion 13 may include mutually different materials.

Case 11 includes housing portion 12 and frame portion 13.

Housing portion 12 is a flat box body that houses light-emitting module 20, light reflector 30, light diffuser 40, and power source unit 60. It should be noted that power source unit 60 need not be included in housing portion 12, and may be disposed, for example, outside of case 11.

Housing portion 12 includes opening 15 through which light emitted by light-emitting module 20 passes, in a surface on the negative side of the Z axis. Opening 15 is covered with frame portion 13 and light diffuser 40. Housing portion 12 houses light diffuser 40 disposed to cover opening 15. Opening 15 corresponds in size to light diffuser 40. In Embodiment 1, opening 15 has a substantially rectangular shape.

Frame portion 13 is a frame-shaped component that fixes light diffuser 40. Frame portion 13 is disposed at the edge of the surface of housing portion 12 on the negative side of the Z axis. In other words, frame portion 13 is disposed on the surface of housing portion 12 on the negative side of the Z axis to surround opening 15 of housing portion 12. Opening portion 13 includes opening 16 through which light emitted by light-emitting module 20 passes. Frame portion 13 has a substantially rectangular shape in a plan view, but is not limited to the substantially rectangular shape. Frame portion 13 may have a shape such as a substantially circular shape, a substantially polygonal shape, and a substantially semi-circular shape. The shape is not particularly limited.

Frame portion 13 includes flange portion 13*a* and rising portion 13*b*. Effect-producing device 10 is recessed in the ceiling so that flange portion 13*a* is flush with the ceiling surface. Rising portion 13*b* is a wall that substantially vertically rises from the end portion of opening 16 that is the inner perimeter of flange portion 13*a* toward the positive side of the Z axis. Rising portion 13*b* supports light diffuser 40 from the negative side of the Z axis.

It should be noted that housing portion 12 and frame portion 13 may be integrally formed to constitute case 11, or housing portion 12 and frame portion 13 may be separately formed and constitute case 11 by being adhered to each other.

Light-emitting module 20 is a module that emits light for forming an image to light diffuser 40. Light-emitting module 20 is held substantially parallel to a plane defined by the X axis and the Y axis.

Light-emitting module 20 includes board 23 and light-emitting elements 22 mounted on board 23.

Board 23 is a printed circuit board for mounting light-emitting elements 22, and has a substantially rectangular shape. Examples of board 23 include a resin-based resin board, a metal-based board, and a ceramic board.

Light-emitting elements 22 are mounted on board 23 in an orientation in which light-emitting elements 22 emit light toward the negative side of the Z axis. Light-emitting elements 22 are mounted on a surface of board 23 on the negative side of the Z axis. For example, light-emitting elements 22 are arranged in rows and columns on board 23. Alternatively, light-emitting elements 22 are arranged at regular intervals on board 23. Light-emitting elements 22 are an example of light sources.

Light-emitting elements 22 are light-emitting diode (LED) elements. In Embodiment 1, light-emitting elements 22 are RGB LED elements that emit blue light, green light, and red light. It should be noted that the LED elements may be surface mount device (SMD) LED elements or a chip on board (COB) light-emitting elements 22. Light-emitting elements 22 are not limited to the RGB LED elements, and may be RGBW (red, green, blue, and white) LED elements or BW (blue and white) LED elements.

Although not shown, disposed on board 23 are signal lines that transmit a control signal from control device 100 and power lines for supplying power from power source unit 60. For example, the signal lines and the power lines connect light-emitting elements 22 in series. Each of light-emitting elements 22 receives the supply of power from power source unit 60 via the power lines, and emits predetermined light according to the control signal received via the signal lines. Because light-emitting elements 22 are the RGB LED elements in Embodiment 1, it is possible to emit light of various colors by controlling the emission of blue light, green light, and red light. In other words, by control device 100 controlling the light emission of each light-emitting element 22, it is possible to emit light for forming an image such as a blue sky, a white cloud, a cloudy sky, and a sky at sunset.

Light reflector 30 is tubular, and is at least partially disposed between light-emitting module 20 and light diffuser 40. Light reflector 30 is an optical component having the property of reflecting light emitted by light-emitting module 20. Specifically, light reflector 30 reflects light incident on the inner surface of light reflector 30 from light-emitting module 20, toward light diffuser 40. The inner surface is a surface on a side facing light reflector 30 and light-emitting module 20.

Light reflector 30 is made of, for example, a metal material such as aluminum, and has the inner surface on which mirror surface treatment or diffusion treatment is performed. The mirror surface treatment is, for example, polishing or lapping. The diffusion treatment is, for example, matting such as anodizing. It should be noted that the diffusion treatment may be performed on at least the inner surface of light reflector 30. Moreover, light reflector 30 need not undergo the mirror surface treatment or the diffusion treatment, and may remain untreated with the mirror surface treatment or the diffusion treatment.

Light diffuser 40 is an optical component that transmits and diffuses light toward the positive side of the Z axis. Specifically, light diffuser 40 is a diffusing panel that transmits and diffuses light incident from an entrance surface that is a surface of light diffuser 40 on the positive side of the Z axis, through an exit surface. Light diffuser 40 corresponds in shape to opening 16 of frame portion 13. Light diffuser 40 has a substantially rectangular shape in a plan view, but is not limited to the substantially rectangular shape. Light diffuser 40 may have a shape such as a substantially circular shape, a substantially polygonal shape, and a substantially semicircular shape. The shape is not particularly limited.

Light diffuser 40 is disposed substantially parallel to module 20 on the negative side of the Z axis below light-emitting module 20 so that light diffuser 40 faces light-emitting module 20. Light diffuser 40 is a board having a rectangular shape in a plan view. Light diffuser 40 covers opening 16 of frame portion 13. In a plan view, light diffuser 40 is fixed to frame portion 13 to cover light-emitting module 20. Accordingly, when light diffuser 40 and light-emitting elements 22 are seen in a plan view, opening 16 of frame portion 13 and an array of light-emitting elements 22 on board 23 have a substantially identical shape so that opening 16 and the array correspond in shape.

In Embodiment 1, light diffuser 40 is supported in housing portion 12 in a state in which light diffuser 40 are between frame portion 13 and light reflector 30. It should be noted that light diffuser 40 may be fixed to frame portion 13 or light reflector 30, and is not limited to Embodiment 1.

For example, light diffuser 40 is manufactured by performing diffusion treatment on a transparent board including glass or a resin material such as transparent acryl or polyethylene terephthalate (PET). Light diffuser 40 includes a transparent material and thereby has a high transmittance. For example, light diffuser 40 has a total transmittance of 80% or higher, or more preferably 90% or higher.

The diffusion treatment is performed on at least one of the entrance surface and exit surface of light diffuser 40. Examples of the diffusion treatment include prism processing by which prisms including minute dot-shaped recesses are formed. The diffusion treatment is not limited to the prism processing, may be performed by texturing or printing.

The haze value of light diffuser 40 that has undergone the diffusion treatment is, for example, at least 10% and at most 90%. By making the haze value at least 10%, it is possible to inhibit light-emitting elements 22 of light-emitting module 20 from appearing as granular to a user, even when light diffuser 40 includes a transparent material. Moreover, by making the haze value at most 90%, it is possible to maintain to some extent the outline of an image projected on light diffuser 40. It should be noted that the haze value can be adjusted according to the shape and size of the prisms formed by the prism processing, for example. The outline of an image is, for example, the outline of a cloud in a blue sky.

Power source unit 60 is a structural component that converts AC power supplied from a commercial power source into DC power having a predetermined level, by rectifying, smoothing, and stepping down, etc. the AC power, and supplies the DC power to light-emitting module 20.

[Illumination Device]

Each illumination device 90 is disposed around effect-producing device 10. Illumination device 90 is, for example, a downlight including light sources that are light-emitting elements 22, and an opening cover. Illumination device 90 is connected to control device 100. The operations of illumination device 90, such as turning on light, turning off light, dimming, and toning, are controlled by control device 100. Illumination device 90 is, for example, a downlight, a ceiling light, or the like. Illumination device 90 is an example of a lighting device.

Each illumination device 90 can emit light in a predetermined color temperature range along a black body locus. Accordingly, illumination device 90 can also emit light ranging from light having a low color temperature, such as red light, to light having a high color temperature, such as blue light. Illumination device 90 is not limited to a particular color temperature, and may be also capable of emitting light having a chromatic color such as red light, blue light, yellow light, and orange light, and light having an achromatic color such as white light.

[Control Device]

Control device 100 controls illumination devices 90 and effect-producing device 10. Control device 100 includes control unit 110 and memory unit 120. Control device 100 may include only control unit 110. In other words, control unit 110 makes up control device 100.

Control unit 110 controls the operations of effect-producing device 10 and each illumination device 90 around effect-producing device 10, such as turning on light, turning off light, dimming, and toning. Control unit 110 controls the light emission of effect-producing device 10 to keep a change in an amount, a color temperature, or a spectral distribution of light emitted by effect-producing device 10 within a predetermined range. In addition, control unit 110 controls the light emission of illumination device 90 to keep a change in an amount, a color temperature, or a spectral distribution of light emitted by illumination device 90 within a predetermined range. The term toning here includes, for example, adjustment of an emission color or color temperature.

Control unit 110 obtains lighting data indicating respective lighting scenes of each illumination device 90 and effect-producing device 10, which are stored in memory unit 120. Control unit 110 controls a color of the first light emitted by illumination device 90, according to the lighting data.

Moreover, control unit 110 controls a color of the second light emitted by effect-producing device 10, according to the lighting data. For example, lighting data for controlling effect-producing device 10 includes data indicating an image simulating a natural sky, such as data for projecting a blue sky, data for projecting a white cloud, data for projecting a cloudy sky, data for projecting a sky at sunset, and data for projecting an evening sun. In other words, each data indicates a lighting scene for which effect-producing device 10 turns on in a predetermined lighting mode. For example, when a blue sky is projected onto effect-producing device 10, control unit 110 obtains from memory unit 120 lighting data for projecting a blue sky, and controls the light emission of light-emitting elements 22 of light-emitting module 20 according to the obtained lighting data. An image simulating an artificially produced blue sky is projected onto light diffuser 40 due to the light emission of light-emitting elements 22.

In this disclosure, control unit 110 controls at least one of a color of the first light emitted by each illumination device 90 and a color of the second light emitted by effect-producing device 10 so that the color of the first light emitted by illumination device 90 and the color of the second light emitted by effect-producing device 10 move into the specified chromaticity range, the color of the first light and the color of the second light being not in a specified chromaticity range.

In Embodiment 1, when a color difference between the color of the first light emitted by each illumination device 90 and the color of the second light emitted by effect-producing device 10 is greater than a specified value, control unit 220 controls the color of the first light emitted by illumination device 90 so that the color of the first light is approximated to the color of the second light.

[Specified Chromaticity Range]

Hereinafter, a specified chromaticity range will be described.

A MacAdam ellipse is generally known that indicates a region on the CIE xy chromaticity diagram which contains colors indistinguishable to a person with color vision, on the basis of the results of color matching experiments. A MacAdam ellipse indicates the standard deviation of variation in distinguishing a specific color at the center, on the CIE xy chromaticity diagram. This MacAdam ellipse is also referred to as a 1-step MacAdam ellipse.

A 3-step MacAdam ellipse has the short side and long side that are three times greater in length (standard deviation) than those of the 1-step MacAdam ellipse. In Embodiment 1, a range corresponding to the 3-step MacAdam ellipse is referred to as a color discrimination threshold that is a limit for color difference discrimination.

Accordingly, the specified chromaticity range is located outside of at least a 3-step MacAdam ellipse after which a color of the first light is approximated to a color of the second light and which includes, as the center, a position expressed in CIE xy chromaticity coordinates for the color of the first light before the approximation. The specified chromaticity range is at least larger than the 3-step MacAdam ellipse, and may be a 4-step MacAdam ellipse or the like.

A more desirable specified chromaticity range is the range of a 3-step MacAdam ellipse that includes, as the center, a position expressed in CIE xy chromaticity coordinates for a color of the second light.

Figure 4:
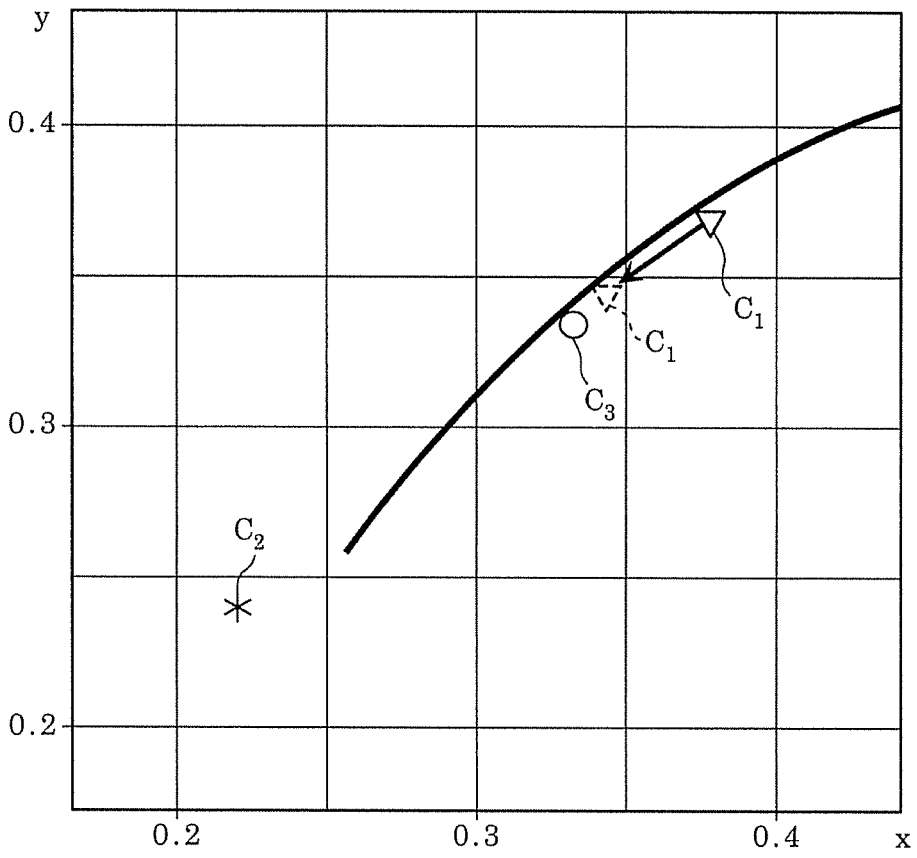
FIG. 4 is a chromaticity diagram showing CIE xy chromaticity coordinates of an XYZ color system for light emitted by the effect-producing device and an illumination device of the illumination system according to Embodiment 1.

FIG. 4 is a chromaticity diagram showing CIE xy chromaticity coordinates of an XYZ color system for light emitted by effect-producing device 10 and each illumination device 90 of illumination system 1 according to Embodiment 1. In FIG. 4, the inverted triangle indicates color C1 of the first light, the asterisk indicates color C2 of the second light, and the circle indicates an achromatic color. Achromatic color C3 is in between color C1 of the first light and color C2 of the second color.

For example, color C1 of the first light is approximated to color C2 of the second light so that color C1 of the first light indicated by the solid line becomes color C1 of the first light indicated by the broken line pointed by the arrow. It should be noted that the positions of color C1 of the first light and color C2 of the second light shown in FIG. 4 are examples, and Embodiment 1 is not limited to these.

Since the colors of the first light and second light are strongly felt due to a color contrast effect between color C1 of the first light and color C2 of the second light, the color contrast effect is reduced by approximating color C1 of the first light to color C2 of the second light.

Hereinafter, a case will be described in which color C1 of the first light is approximated to color C2 of the second light.

Figure 5:
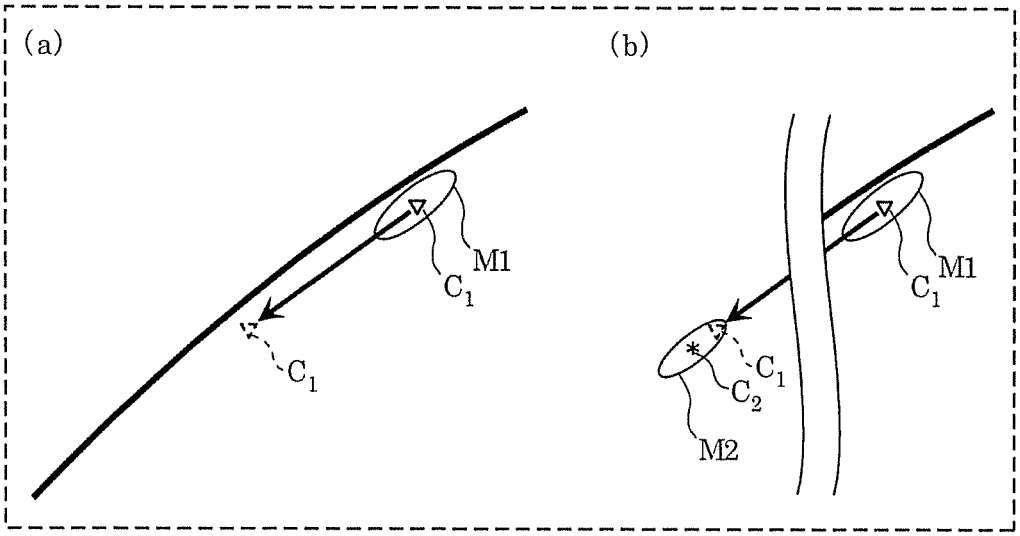
FIG. 5 is a diagram illustrating a movement within the CIE xy chromaticity coordinates indicated by a color of the first light.

FIG. 5 is a diagram illustrating a movement within the CIE xy chromaticity coordinates indicated by a color of the first light.

In (a) in FIG. 5, when color C1 of the first light and color C2 of the second light are expressed in CIE xy chromaticity coordinates, control unit 110 moves color C1 of the first light outside of at least 3-step MacAdam ellipse M1 which includes, as the center, a position expressed in CIE xy chromaticity coordinates for color C1 of the first light before approximation. In Embodiment 1, control unit 110 moves, along a black body locus, color C1 of the first light indicted by the solid line to color C1 of the first light indicated by the broken line which is outside of 3-step MacAdam ellipse M1. The destination is within the specified chromaticity range.

In (b) in FIG. 5, control unit 110 may move a color of the first light into 3-step MacAdam ellipse M2 which includes, as the center, a position expressed in CIE xy chromaticity coordinates for a color of the second light. In Embodiment 1, as in (b) in FIG. 5, color C1 of the first light indicated by the solid line may be moved to color C1 of the first light indicated by the broken line which is located within 3-step MacAdam ellipse M2.

In (b) in FIG. 5, since the ellipse is neither discriminable to nor easily discriminated by the user, the color contrast effect between the color of the first light and the color of the second light is reduced.

Moreover, control unit 110 may determine whether a color of the first light is within the specified chromaticity range, according to, for example, whether a color difference between the color of the first light and a color of the second light included in an image displayed according to lighting data is less than or equal to a specified value. In other words, when the color difference is greater than the specified value, the color of the first light is not within the specified chromaticity range, and when the color difference is less than or equal to the specified value, the color of the first light is within the specified chromaticity range.

Refer back to the description of control device 100 shown in FIG. 1 to FIG. 3. Control unit 110 causes each illumination device 90 to change a color of the first light emitted by each illumination device 90, according to a change in image. For example, when a cloudy sky is projected after a blue sky is projected, control unit 110 causes illumination device 90 to change the color of the first light according to the change in image. To give an example, control unit 110 decreases an amount by which the color of the first light is approximated to the color of the second light when the cloudy sky is projected more than an amount by which the color of the first light is approximated to the color of the second light when the blue sky is projected.

Control unit 110 controls a color of the first light emitted by each illumination device 90 so that illumination devices 90 have a smaller color difference between the color of the first light and a color of the second light with decreasing distance from effect-producing device 10. In other words, control unit 110 controls illumination device 90 so that a color of the first light emitted by illumination device 90 at the second distance from effect-producing device 10 is more approximated to the color of the second light emitted by effect-producing device 10 than a color of the first light emitted by illumination device 90 at the first distance from effect-producing device 10, the second distance being greater than the first distance.

For example, when illumination devices 90 are installed in a part of a building, a user may input a distance from effect-producing device 10 to each illumination device 90 into memory unit 120 via operation unit 150. Control unit 110 may control the color of the first light emitted by illumination device 90, according to the distance from effect-producing device 10 to illumination device 90 stored in memory unit 120.

Control unit 110 is electrically connected to effect-producing device 10 via a signal line. Control unit 110 sends a control signal including information about luminance of each of the green LEDs, green LEDs, and red LEDs of effect-producing device 10, to light-emitting elements 22 of effect-producing device 10 via the signal line according to lighting data obtained from memory unit 120. Having received the control signal, light-emitting elements 22 emits blue light, green light, and red light according to the control signal.

Control unit 110 sends a control signal to light-emitting module 20 of effect-producing device 10 at time intervals at which, for example, a motion of an image does not become unnatural. Accordingly, when, for example, an image simulating a cloud moving in a blue sky, it is possible to display a more natural motion.

Memory unit 120 stores lighting data indicating a lighting scene for a color of the second light produced by effect-producing device 10. Memory unit 120 may be a nonvolatile memory or a nonvolatile memory such as an SRAM.

[Operation Unit]

Operation unit 150 is an operation terminal that is connected to control device 100 and is capable of operating each illumination device 90 and effect-producing device 10 via control device 100. Operation unit 150 is, for example, a touch panel, an operation button installed in a wall etc., and a remote control. A user may perform reading of lighting data stored in memory unit 120 via operation unit 150, or may be able to newly set lighting data for controlling each illumination device 90 and effect-producing device 10 via operation unit 150.

[Operation]

Next, operation of control device 100, illumination device 90, effect-producing device 10, and illumination system 1 will be described.

Figure 6:
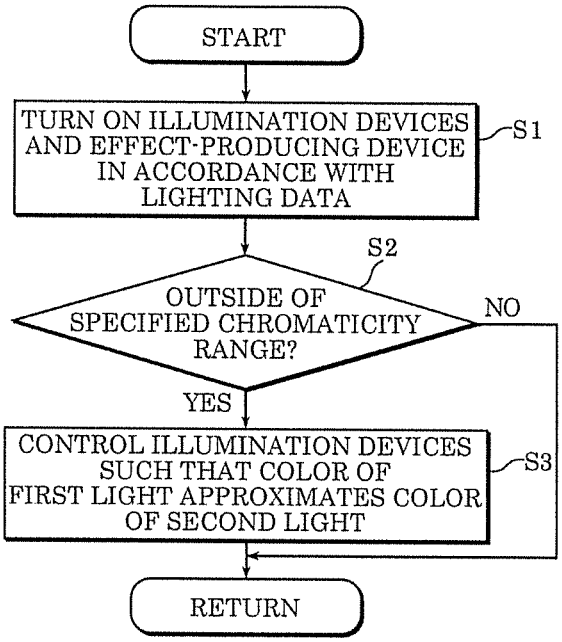
FIG. 6 is a flow diagram illustrating operation of the illumination system according to Embodiment 1.

FIG. 6 is a flow diagram illustrating operation of illumination system 1 according to Embodiment 1.

As shown in FIG. 6, for example, when a user intends to cause effect-producing device 10 to display a blue sky, control unit 110 of control device 100 obtains lighting data from memory unit 120. Control unit 110 turns on each illumination device 90 and effect-producing device 10 in a lighting scene according to the lighting data (S1). At this time, for example, control unit 110 controls light emission of light-emitting elements 22 of light-emitting module 20 so that an image displayed on light diffuser 40 achieves an area ratio between a white cloud and a blue sky according to the lighting data.

Next, control unit 110 determines whether a color of the second light emitted by effect-producing device 10 is outside of a specified chromaticity range, according to the lighting data (S2).

When the color of the second light is outside of the specified chromaticity range (YES in S2), as shown in (a) or (b) in FIG. 5, control unit 110 controls each illumination device 90 so that a color of the first light emitted by illumination device 90 is approximated to the color of the second light emitted by effect-producing device 10 (S3). Here, control unit 110 controls illumination device 90 so that a color difference between the color of the first light and the color of the second light gradually becomes smaller with decreasing distance from effect-producing device 10 to illumination device 90. In addition, control unit 110 controls illumination devices 90 so that illumination devices 90 each have a smaller color difference with decreasing distance from effect-producing device 10.

In contrast, when the color of the second light is within the specified chromaticity range (NO in S2), control unit 110 leaves alone the color of the first light emitted by each illumination device 90. Subsequently, the flow returns to the start, and the operation of illumination system 1 is repeated.

[Summary]

In such illumination system 1, control unit 110 of control device 100 controls light-emitting module 20 of effect-producing device 10 according to the lighting data stored in memory unit 120. As a result, light emitted by light-emitting elements 22 of light-emitting module 20 is incident on the entrance surface of light diffuser 40 by being reflected by light reflector 30, or is directly incident on the entrance surface of light diffuser 40. Such light is passed through and diffused by light diffuser 40 to exit through the exit surface of light diffuser 40.

Figure 7:
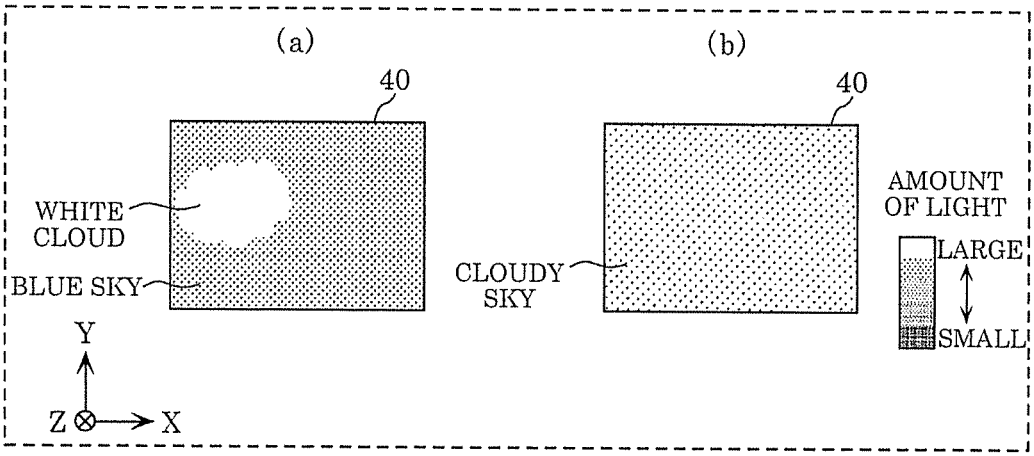
FIG. 7 is a conceptual diagram illustrating an example of an image projected on the effect-producing device of the illumination system according to Embodiment 1.

FIG. 7 is a conceptual diagram illustrating an example of an image projected on effect-producing device 10 of illumination system 1 according to Embodiment 1. In (a) and (b) in FIG. 7, differences in amount of light emitted by light diffuser 40 are expressed by dot shading.

As shown in (a) in FIG. 7, one big white cloud and a blue sky that is a background are projected on light diffuser 40. As shown in (b) in FIG. 7, a cloudy sky that is an image after the passage of a predetermined time from (a) in FIG. 7 is projected on light diffuser 40. Control unit 110 controls light-emitting elements 22 so that an area ratio between the white cloud region and the blue sky region becomes a predetermined ratio according to lighting data. As a result, an image based on the lighting data is projected on light diffuser 40. For this reason, an image simulating a natural sky such as a change in shading of blue sky and the changes of the white cloud is displayed on light diffuser 40 according to the lighting data.

Moreover, when the color of the second light emitted by effect-producing device 10 is within or outside of the specified chromaticity range, control unit 110 of control device 100 controls each illumination device 90 according to lighting data so that the color of the first light emitted by illumination device 90 is approximated to the color of the second light emitted by effect-producing device 10.

Furthermore, control unit 110 changes the lighting mode of each illumination device 90 in accordance with the image projected on light diffuser 40 according to the lighting data. Consequently, control unit 110 changes the color of the first light emitted by illumination device 90 according to the change in image projected on light diffuser 40.

Besides, control unit 110 controls each illumination device 90 so that a color difference between the color of the first light and the color of the second light gradually becomes smaller with decreasing distance from effect-producing device 10 to illumination device 90. With this, the color difference between the color of the second light emitted by effect-producing device 10 and the color of the first light emitted by illumination device 90 becomes smaller, and thus it is possible to ease the discomfort of the user looking at illumination system 1.

Advantageous Effects

Next, advantageous effects produced by control device 100, illumination device 90, effect-producing device 10, and illumination system 1 in Embodiment 1 will be described.

As described above, control device 100 according to Embodiment 1 controls illumination device 90 that illuminates a surrounding area, and effect-producing device 10 that emits light producing an effect on the surrounding area. Control device 100 controls at least one of a color of first light emitted by illumination device 90 and a color of second light emitted by effect-producing device 10 so that at least one of the color of the first light and the color of the second light moves into a specified chromaticity range, the color of the first light and the color of the second light being outside of the specified chromaticity range. Colors in the specified chromaticity range are recognized as a same color by a human.

In this manner, control unit 110 controls at least one of the color of the first light emitted by illumination device 90 and the color of the second light emitted by effect-producing device 10 so that at least one of the color of the first light and the color of the second light moves into the specified chromaticity range, the color of the first light and the color of the second light being outside of the specified chromaticity range. For this reason, it is possible to ease the discomfort of a user caused by a color difference between the color of the first light emitted by illumination device 90 and the color of the second light emitted by effect-producing device 10.

Accordingly, control device 100 can ease the discomfort of the user caused by the color difference, by reducing a color contrast effect.

Moreover, illumination device 90 or effect-producing device 10 according to Embodiment 1 may include control device 100 and a light source that emits light, serving as illumination device 90 or effect-producing device 10.

Moreover, illumination system 1 according to Embodiment 1 may include illumination device 90, effect-producing device 10, and control device 100 that controls illumination device 90 and effect-producing device 10.

These configurations can also produce the same advantageous effects as above.

Moreover, in control device 100 according to Embodiment 1, control unit 110 may control the color of the first light emitted by illumination device 90 so that the color of the first light is approximated to the color of the second light.

Control unit 110 approximates the color of the first light to the color of the second light as above, and thus it is possible to ease the discomfort of the user caused by the color difference.

Moreover, it is not necessary to generate lighting data for controlling effect-producing device, by controlling a lighting scene of effect-producing device 90.

Moreover, in control device 100 according to Embodiment 1, illumination devices 90 may be disposed around effect-producing device 10. Control unit 110 may control the color of the first light emitted by each illumination device 90 so that illumination devices 90 each have a smaller color difference between the color of the first light and the color of the second light with decreasing distance from effect-producing device 10.

In this manner, control unit 110 controls the color of the first light emitted by each illumination device 90 so that illumination devices 90 each have a smaller color difference between the color of the first light and the color of the second light with decreasing distance from effect-producing device 10. For this reason, a color difference between effect-producing device 10 and each illumination device 90 close to effect-producing device 10 is reduced, and thus it is possible to ease the discomfort caused by the color difference between effect-producing device 10 and illumination device 90.

In addition, each illumination device 90 far from effect-producing device 10 does not easily bring the discomfort to the user caused by a color difference. For this reason, it is sufficient that control unit 110 controls any illumination device 90 in a limited range. Consequently, control device 100 can prevent an increase in processing load of control unit 110.

Moreover, in control device 100 according to Embodiment 1, when the color of the first light and the color of the second light are expressed in CIE xy chromaticity coordinates, control unit 110 may move the color of the first light outside of at least a 3-step MacAdam ellipse that includes, as a center, a position expressed in CIE xy chromaticity coordinates for the color of the first light before being approximated to the color of the second light.

In this manner, as shown in (a) in FIG. 5, in order that the color of the first light is approximated to the color of the second light, control unit 110 moves the color of the first light outside of the at least 3-step MacAdam ellipse that includes, as the center, the position expressed in CIE xy chromaticity coordinates for the color of the first light before being approximated to the color of the second light. For this reason, the user can recognize that the color of the first light is changed and approximated to the color of the second light. Accordingly, it is possible to ease the discomfort of the user caused by the color difference.

Moreover, in control device 100 according to Embodiment 1, control unit 110 may move the color of the first light into a 3-step MacAdam ellipse that includes, as a center, a position expressed in CIE xy chromaticity coordinates for the color of the second light.

Control unit 110 moves the color of the first light into the 3-step MacAdam ellipse that includes, as the center, the position expressed in CIE xy chromaticity coordinates for the color of the second light as above, and thus the user can recognize the color of the first light and the color of the second light as equivalent colors. Accordingly, it is possible to ease the discomfort of the user caused by the color difference.

Moreover, control device 100 according to Embodiment 1 further includes memory unit 120 that stores lighting data indicating the color of the second light emitted by effect-producing device 10. Control unit 110 may control the color of the first light emitted by illumination device 90, according to the lighting data stored in memory unit 120.

In this manner, control unit 110 can control the color of the first light emitted by illumination device 90, according to the color of the second light emitted by effect-producing device 10 indicated by the lighting data. As a result, it is possible to easily ease the discomfort of the user caused by the color difference.

Moreover, in control device 100 according to Embodiment 1, control unit 110 may move, along a black body locus, the color of the first light emitted by illumination device 90 so that the color of the first light is approximated to the color of the second light.

Moreover, illumination device 90 according to Embodiment 1 includes board 23 and light-emitting elements 22 arranged in a matrix on board 23.

Moreover, control device 100 according to Embodiment 1 controls illumination device 90 (one example of a first illumination device) for emitting first light, and effect-producing device 10 (one example of a second illumination device) for emitting second light having a different configuration than illumination device 90. Control device 100 also adjusts at least one of illumination device 90 and effect-producing device 10 so that a difference between an adjusted color of the first light and an adjusted color of the second light is within a predetermined chromaticity range. The predetermined chromaticity range is a range with which a human recognizes that the adjusted color of the first light and the adjusted color of the second light are identical.

Moreover, control device 100 according to Embodiment 1 controls illumination device 90 that illuminates a surrounding area, and effect-producing device 10 that emits light producing an effect on the surrounding area. Control device 100 adjusts at least one of a first initial color of first light emitted by illumination device 90 and a second initial color of second light emitted by effect-producing device 10 so that a difference between an adjusted first initial color of the first light and an adjusted second initial color of the second light is within a predetermined chromaticity range. The predetermined chromaticity range is a range with which a human recognizes that the adjusted first initial color of the first light and the adjusted second initial color of the second light are identical.

Moreover, control device 100 according to Embodiment 1 controls illumination device 90 that illuminates a surrounding area and emits first light having a first color, and effect-producing device 10 that emits light producing an effect on the surrounding area and emits second light having a second color. Control device 100 controls at least one of illumination device 90 and effect-producing device 10 to adjust at least one of the first light and the second light. Before adjustment by control device 100, the first light has a first initial color having a first n-step MacAdam ellipse, and the second light has a second initial color having a second n-step MacAdam ellipse, n being 1, 2, 3 or 4. When the first initial light is not within the second n-step MacAdam ellipse and the second initial light is not within the first n-step MacAdam ellipse, control device 100 adjusts at least one of the first initial light and the second initial light such that a first adjusted light after the adjustment is within a second n-step MacAdam ellipse after the adjustment or a second adjusted light is within a first n-step MacAdam ellipse after the adjustment.

Moreover, control device 100 according to Embodiment 1 controls illumination device 90 that illuminates a surrounding area, and effect-producing device 10 that emits light producing an effect on the surrounding area. When a first color of first light emitted by illumination device 90 and a second color of second light emitted by effect-producing device 10 are expressed in CIE xy chromaticity coordinates, and when at least a 3-step MacAdam ellipse of the second color of the second light is outside of at least a 3-step MacAdam ellipse of the first color of the first light, control device 100 causes the first color of the first light to move to outside of the at least 3-step MacAdam ellipse that includes, as a center, a position expressed in CIE xy chromaticity coordinates for the first color of the first light before being approximated to the second color of the second light.

Moreover, control device 100 according to Embodiment 1 controls illumination device 90 that illuminates a surrounding area, and effect-producing device 10 that emits light producing an effect on the surrounding area. When a first color of first light emitted by illumination device 90 and a second color of second light emitted by effect-producing device 10 are expressed in CIE xy chromaticity coordinates, and when at least a 3-step MacAdam ellipse of the second color of the second light is outside of at least a 3-step MacAdam ellipse of the first color of the first light, control device 100 causes the first color of the first light to move into the at least 3-step MacAdam ellipse that includes, as a center, a position expressed in CIE xy chromaticity coordinates for the second color of the second light before being approximated to the second color of the second light.

Moreover, control device 100 according to Embodiment 1 controls illumination device 90 that illuminates a surrounding area, and effect-producing device 10 that emits light producing an effect on the surrounding area. When a first color of first light emitted by illumination device 90 and a second color of second light emitted by effect-producing device 10 are expressed in CIE xy chromaticity coordinates, and when at least a 3-step MacAdam ellipse of the second color of the second light is outside of at least a 3-step MacAdam ellipse of the first color of the first light, control device 100 causes the second color of the second light to move to outside of the at least 3-step MacAdam ellipse that includes, as a center, a position expressed in CIE xy chromaticity coordinates for the second color of the second light before being approximated to the first color of the first light.

Moreover, control device 100 according to Embodiment 1 controls illumination device 90 that illuminates a surrounding area, and effect-producing device 10 that emits light producing an effect on the surrounding area. When a first color of first light emitted by illumination device 90 and a second color of second light emitted by effect-producing device 10 are expressed in CIE xy chromaticity coordinates, and when at least a 3-step MacAdam ellipse of the second color of the second light is outside of at least a 3-step MacAdam ellipse of the first color of the first light, control device 100 causes the second color of the second light to move into the at least 3-step MacAdam ellipse that includes, as a center, a position expressed in CIE xy chromaticity coordinates for the first color of the first light before being approximated to the first color of the first light.

Embodiment 2

[Configuration]

Configurations of control device 100, illumination device 90, effect-producing device 10, and illumination system 1 according to Embodiment 2 will be described.

In Embodiment 1, the color of the first light emitted by at least one illumination device 90 is approximated to the color of the second light emitted by effect-producing device 10. In contrast, in Embodiment 2, a color of the second light emitted by effect-producing device 10 is approximated to a color of the first light emitted by illumination device 90. The configurations of control device 100, illumination device 90, effect-producing device 10, and illumination system 1 according to Embodiment 2 are identical to those of Embodiment 1, unless otherwise specified. Accordingly, the same components are assigned the same reference signs, and detailed description of the components is omitted.

In Embodiment 2, when the color of the first light emitted by at least one illumination device 90 is within the specified chromaticity range, and the color of the second light emitted by effect-producing device 10 is outside of the specified chromaticity range, control unit 110 controls the color of the second light emitted by effect-producing device 10 so that the color of the second light is approximated to the color of the first light.

Moreover, control unit 110 controls not only effect-producing device 10 but also the color of the first light emitted by each illumination device 90 according to lighting data stored in memory unit 120. In other words, when the color of the second light is outside of the specified chromaticity range, control unit 110 controls the color of the second light emitted by effect-producing device 10 according to the color difference.

Control unit 110 controls effect-producing device 10 so that illumination devices 90 each have a smaller color difference between the color of the first light and the color of the second light with decreasing distance from effect-producing device 10. In other words, control unit 110 controls the color of the second light emitted by effect-producing device 10 so that the color of the second color is approximated more to a color of the first light emitted by illumination device 90 at the second distance from effect-producing device 10 than to a color of the first light emitted by illumination device 90 at the first distance from effect-producing device 10, the first distance being greater than the second distance.

Memory unit 120 stores lighting data indicating a lighting scene for a color of the first light emitted by illumination device 90.

Figure 8:
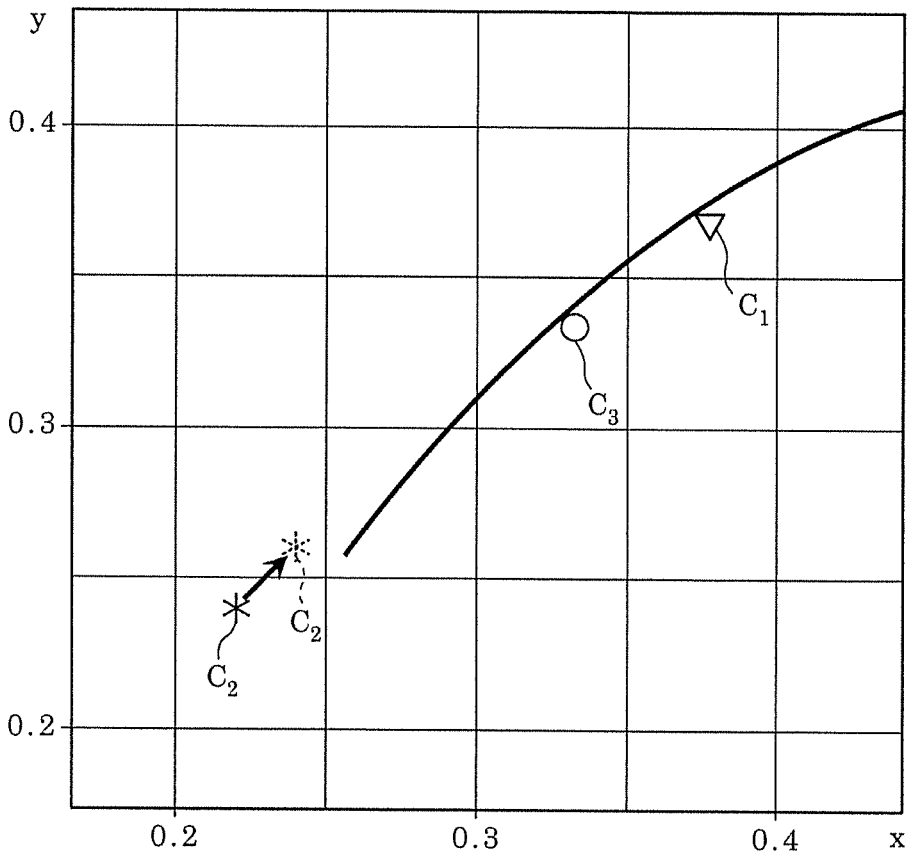
FIG. 8 is a chromaticity diagram showing CIE xy chromaticity coordinates of an XYZ color system for light emitted by an effect-producing device and an illumination device of an illumination system according to Embodiment 2.

FIG. 8 is a chromaticity diagram showing CIE xy chromaticity coordinates of an XYZ color system for light emitted by effect-producing device 10 and illumination device 90 of illumination system 1 according to Embodiment 2.

For example, a color of the second light is approximated to a color of the first light so that color C2 of the second light indicated by the solid line becomes color C2 of the second light indicated by the broken line indicated by the arrow. It should be noted that the position of the asterisk indicated by the broken line is an example, and Embodiment 2 is not limited to this.

Since the colors of the first light and second light are strongly felt due to a color contrast effect between color C2 of the second light and color C1 of the first light, the color contrast effect is reduced by approximating color C2 of the second light to color C1 of the first light.

Figure 9:
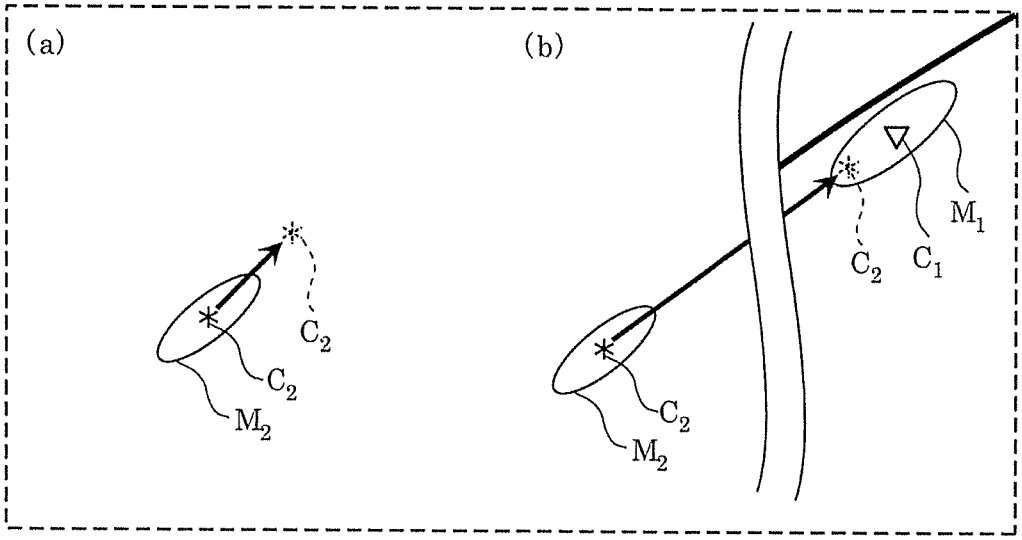
FIG. 9 is a diagram illustrating a movement within the CIE xy chromaticity coordinates indicated by a color of the second light.

FIG. 9 is a diagram illustrating a movement within the CIE xy chromaticity coordinates indicated by a color of the second light.

In (a) in FIG. 9, when color C1 of the first light and color C2 of the second light are expressed in CIE xy chromaticity coordinates, control unit 110 moves color C2 of the second light outside of at least 3-step MacAdam ellipse M2 which includes, as the center, a position expressed in CIE xy chromaticity coordinates for color 2 of the second light before approximation. In Embodiment 2, control unit 110 moves, along a black body locus, color C2 of the second light indicted by the solid line to color C2 of the second light indicated by the broken line which is outside of 3-step MacAdam ellipse M2. The destination is within the specified chromaticity range.

In (b) in FIG. 9, control unit 110 may move a color of the second light into 3-step MacAdam ellipse M1 which includes, as the center, a position expressed in CIE xy chromaticity coordinates for a color of the first light. In Embodiment 2, as in (b) in FIG. 9, color C2 of the second light indicated by the solid line may be moved to color C2 of the second light indicated by the broken line which is located within 3-step MacAdam ellipse M1.

In (b) in FIG. 9, since the ellipse is neither discriminable to nor easily discriminated by the user, the color contrast effect between the color of the first light and the color of the second light is reduced.

[Operation]

Next, operation of control device 100, illumination device 90, effect-producing device 10, and illumination system 1 will be described.

Figure 10:
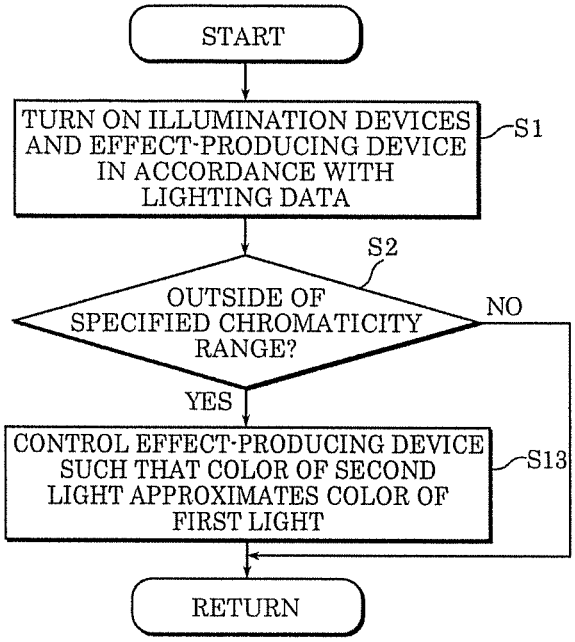
FIG. 10 is a flow diagram illustrating operation of the illumination system according to Embodiment 2.

FIG. 10 is a flow diagram illustrating operation of illumination system 1 according to Embodiment 2. Description of the same steps as in FIG. 6 is omitted.

As shown in FIG. 10, for example, when a user intends to cause effect-producing device 10 to display a blue sky, control unit 110 of control device 100 obtains lighting data from memory unit 120. Control unit 110 turns on each illumination device 90 and effect-producing device 10 in a lighting scene according to the lighting data (S1).

Next, control unit 110 determines whether a color of the second light emitted by effect-producing device 10 is outside of a specified chromaticity range, according to the lighting data (S2).

When the color of the second light is outside of the specified chromaticity range (YES in S2), as shown in (a) or (b) in FIG. 9, control unit 110 controls effect-producing device 10 so that the color of the second light emitted by effect-producing device 10 is approximated to a color of the first light emitted by each illumination device 90 (S13).

In contrast, when the color of the second light is within the specified chromaticity range (NO in S2), control unit 110 leaves alone the color of the second light emitted by effect-producing device 10. Subsequently, the flow returns to the start, and the operation of illumination system 1 is repeated.

Advantageous Effects

Next, advantageous effects produced by control device 100, illumination device 90, effect-producing device 10, and illumination system 1 in Embodiment 2 will be described.

As described, in control device 100 according to Embodiment 2, control unit 110 may control the color of the second light emitted by effect-producing device 10 so that the color of the second light is approximated to the color of the first light.

Control unit 110 approximates the color of the second light to the color of the first light as above, and thus it is possible to ease the discomfort of the user caused by the color difference.

Moreover, in control device 100 according to Embodiment 2, when the color of the first light and the color of the second light are expressed in CIE xy chromaticity coordinates, control unit 110 may move the color of the second light outside of at least a 3-step MacAdam ellipse that includes, as a center, a position expressed in CIE xy chromaticity coordinates for the color of the second light before being approximated to the color of the first light.

In this manner, as shown in (a) in FIG. 9, in order that the color of the second light is approximated to the color of the first light, control unit 110 moves the color of the second light outside of the at least 3-step MacAdam ellipse that includes, as the center, the position expressed in CIE xy chromaticity coordinates for the color of the second light before being approximated to the color of the first light. For this reason, the user can recognize that the color of the second light is changed and approximated to the color of the first light. Accordingly, it is possible to ease the discomfort of the user caused by the color difference.

Moreover, in control device 100 according to Embodiment 2, control unit 110 may move the color of the second light into a 3-step MacAdam ellipse that includes, as a center, a position expressed in CIE xy chromaticity coordinates for the color of the first light.

Control unit 110 moves the color of the second light into the 3-step MacAdam ellipse that includes, as the center, the position expressed in CIE xy chromaticity coordinates for the color of the first light as above, and thus the user can recognize the color of the first light and the color of the second light as equivalent colors. Accordingly, it is possible to ease the discomfort of the user caused by the color difference.

Moreover, control device 100 according to Embodiment 2 further includes memory unit 120 that stores lighting data indicating the color of the first light emitted by illumination device 90. Control unit 110 may control the color of the second light emitted by effect-producing device 10, according to the lighting data stored in memory unit 120.

In this manner, control unit 110 can control the color of the second light emitted by effect-producing device 10, according to the color of the first light emitted by illumination device 90 indicated by the lighting data. As a result, it is possible to easily ease the discomfort of the user caused by the color difference.

Moreover, in control device 100 according to Embodiment 2, control unit 110 may move, along a black body locus, the color of the second light emitted by illumination device 90 so that the color of the second light is approximated to the color of the first light.

The other advantageous effects produced by Embodiment 2 are the same as those produced by Embodiment 1.

Embodiment 3

[Configuration]

Configurations of control device 201, illumination device 90, effect-producing device 10, and illumination system 200 according to Embodiment 3 will be described.

Figure 11:
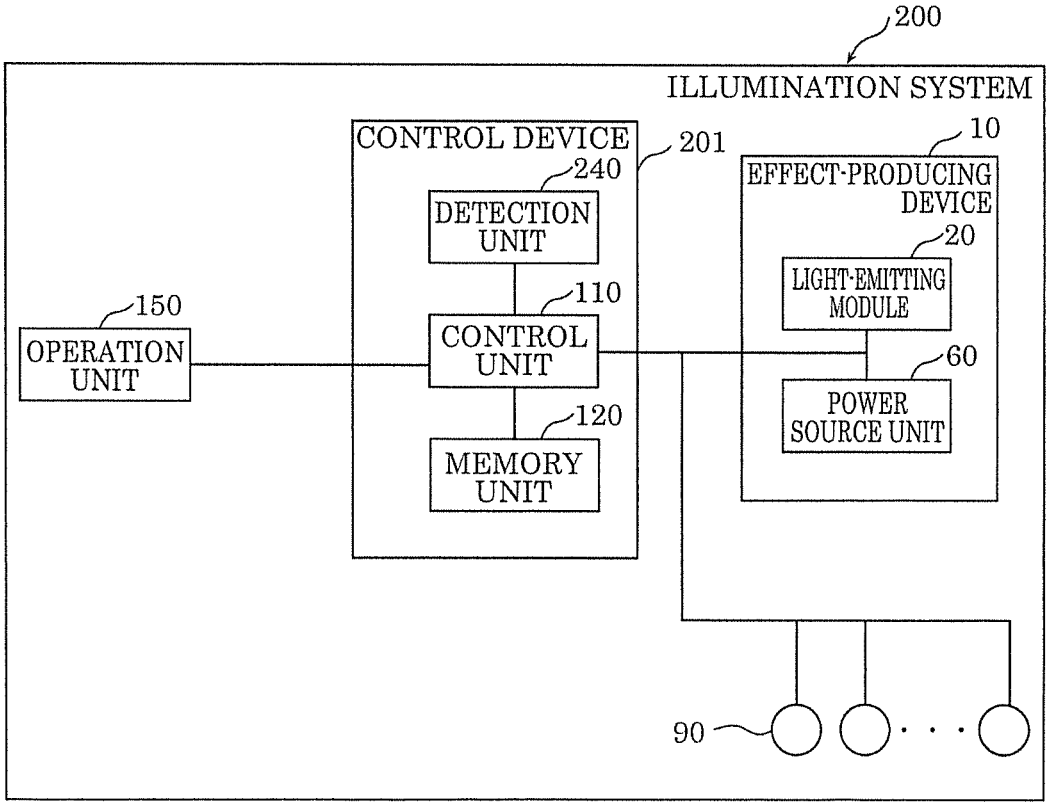
FIG. 11 is a block diagram illustrating an illumination system according to Embodiment 3.

FIG. 11 is a block diagram illustrating illumination system 200 according to Embodiment 3.

As shown in FIG. 11, Embodiment 3 differs from Embodiment 1 in that illumination system 200 includes detection unit 240. The configurations of control device 201, illumination device 90, effect-producing device 10, and illumination system 200 according to Embodiment 3 are identical to those of Embodiment 1 etc., unless otherwise specified. Accordingly, the same components are assigned the same reference signs, and detailed description of the components is omitted.

Besides illumination devices 90, effect-producing device 10, and control device 201, illumination system 200 includes detection unit 240. In Embodiment 3, control device 201 includes detection unit 240. It should be noted that illumination device 90 and effect-producing device 10 may include detection unit 240. In addition, detection unit 240 may be provided separately from each illumination device 90, effect-producing device 10, and control device 201, and may be configured as a device included in illumination system 200.

Detection unit 240 detects a color of the first light emitted by each illumination device 90, and a color of the second light emitted by effect-producing device 10. Detection unit 240 includes multiple types of photoelectric conversion elements for detecting different colors, for example. By directly using or amplifying an output from each of the multiple types of photoelectric conversion elements, detection unit 240 generates a detection signal indicating the detection of the color of the first light emitted by illumination device 90, and a detection signal indicating the detection of the color of the second light emitted by effect-producing device 10. Detection unit 240 sends the generated detection signals to control unit 110. Examples of detection unit 240 include a color meter and a color illuminance meter.

When the color of the first light is approximated to the color of the second light, upon obtaining the detection signals from detection unit 240, control unit 110 controls the color of the first light emitted by each illumination device 90, according to the color of the second light emitted by effect-producing device 10 which is indicated by the detection signal.

Moreover, to give another example, control unit 110 may calculate a color difference between the color of the first light and the color of the second light indicated by the detection signals, and determine whether the color difference is less than or equal to a predetermined value. In this case, when the color difference is less than or equal to the predetermined value, control unit 110 controls the color of the first light emitted by each illumination device 90 so that the color of the first light is approximated to the color of the second light.

When the color of the second light is approximated to the color of the first light, upon obtaining the detection signals from detection unit 240, control unit 110 controls the color of the second light emitted by effect-producing device 10, according to the color of the first light emitted by each illumination device 90 which is indicated by the detection signal.

Moreover, to give another example, control unit 110 may calculate a color difference between the color of the second light and the color of the first light indicated by the detection signals, and determine whether the color difference is less than or equal to a predetermined value. In this case, when the color difference is greater than the predetermined value, control unit 110 controls the color of the second light emitted by effect-producing device 10 so that the color of the second light is approximated to the color of the first light.

[Operation]

Next, operation of control device 201, illumination device 90, effect-producing device 10, and illumination system 200 will be described.

Figure 12:
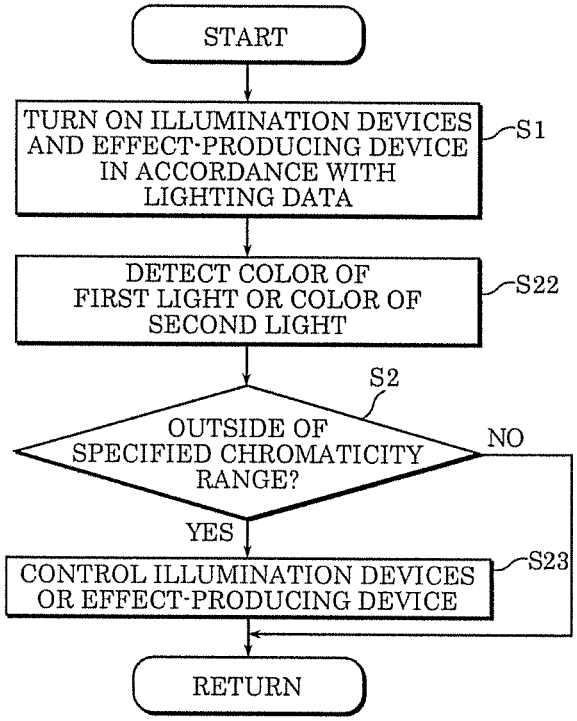
FIG. 12 is a flow diagram illustrating operation of the illumination system according to Embodiment 3.

FIG. 12 is a flow diagram illustrating operation of illumination system 200 according to Embodiment 3. Description of the same steps as in FIG. 6 is omitted.

As shown in FIG. 12, for example, when a user intends to cause effect-producing device 10 to display a blue sky, control unit 110 of control device 201 obtains lighting data from memory unit 120. Control unit 110 turns on each illumination device 90 and effect-producing device 10 in a lighting scene according to the lighting data (S1).

Next, control unit 110 obtains from detection unit 240 a detection signal indicating a color of the first light emitted by each illumination device 90 or a color of the second light emitted by effect-producing device 10 (S22).

Next, control unit 110 determines whether the color of the first light or the color of the second light is outside of a specified chromaticity range according to the color of the first light or the color of the second light indicated by the detection signal (S2).

When the color of the first light or the color of the second light is outside of the specified chromaticity range (YES in S2), control unit 110 controls effect-producing device 10 so that the color of the first light emitted by each illumination device 90 is approximated to the color of the second light emitted by effect-producing device 10, or controls illumination device 90 so that the color of the second light emitted by effect-producing device 10 is approximated to the color of the first light emitted by illumination device 90 (S23).

In contrast, when the color of the first light or the color of the second light is within the specified chromaticity range (NO in S2), control unit 110 leaves alone the color of the first light emitted by each illumination device 90 or the color of the second light emitted by effect-producing device 10. Subsequently, the flow returns to the start, and the operation of illumination system 200 is repeated.

Advantageous Effects

Next, advantageous effects produced by control device 201, illumination device 90, effect-producing device 10, and illumination system 200 in Embodiment 3 will be described.

As described, control device 201 according to Embodiment 3 further includes detection unit 240 that detects the color of the second light emitted by effect-producing device 10. Control unit 110 may control the color of the first light emitted by illumination device 90, according to the color of the second light detected by detection unit 240.

Detection unit 240 detects the color of the second light emitted by effect-producing device 10 as above, control unit 110 can accurately calculate a color difference between the color of the second light and the color of the first light. For this reason, control unit 110 can keep the color of the second light and the color of the first light within a specified chromaticity range. In other words, it is possible to make the color difference between the color of the second light and the color of the first light less than or equal to a specified value. Accordingly, control device 201 can ease the discomfort of the user caused by the color difference.

Moreover, control device 201 according to Embodiment 3 further includes detection unit 240 that detects the color of the first light emitted by illumination device 90. Control unit 1110 may control the color of the second light emitted by effect-producing device 10, according to the color of the first light detected by detection unit 240.

Detection unit 240 detects the color of the first light emitted by illumination device 90 as above, control unit 110 can accurately calculate a color difference between the color of the second light and the color of the first light. For this reason, control unit 110 can keep the color of the first light and the color of the second light within a specified chromaticity range. In other words, it is possible to make the color difference between the color of the first light and the color of the second light less than or equal to a specified value. Accordingly, control device 201 can ease the discomfort of the user caused by the color difference.

The other advantageous effects produced by Embodiment 3 are the same as those produced by Embodiment 1 etc.

Other Variations Etc.

Although the present disclosure has been described based on Embodiments 1 to 3, the present disclosure is not limited to Embodiments 1 to 3.

For example, in the control device, lighting device, and illumination system according to each of Embodiments 1 to 3, the control device may be provided in the effect-producing device or the illumination device, or may be provided as a device different from the effect-producing device and the illumination device.

Figure 13:
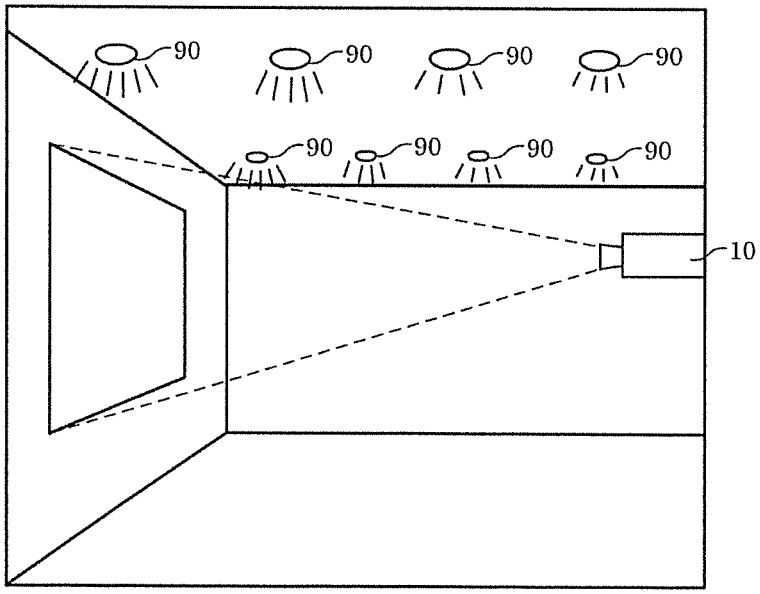
FIG. 13 is a schematic diagram illustrating an illumination system according to a variation.

Moreover, in the control device, lighting device, and illumination system according to each of Embodiments 1 to 3, effect-producing device 10 may be a projector as shown in FIG. 13. FIG. 13 is a schematic diagram illustrating an illumination system according to a variation. FIG. 13 shows a state in which illumination devices 90 emit light and effect-producing device 10 projects an image toward a wall. In this case, the control device controls a color of the first light emitted by each illumination device 90 so that illumination devices 90 are within in a specified chromaticity range with decreasing distance to a target surface of the wall on which the image is projected.

Moreover, in the lighting device and illumination system according to each of Embodiments 1 to 3 or Variations 1 and 2 of those, the illumination devices may be housed in a case of the effect-producing device. In this case, each illumination device may be fixed to the flange portion of the frame portion.

Moreover, in the control device, lighting device, and illumination system according to Embodiment 1 or 3, although the operation unit and the control device are connected via a wired connection, the operation unit and the control device may be connected wirelessly. In this case, the operation unit and the control device may include respective communication units capable of communicating with each other.

Moreover, each of processing units included in the control device, lighting device, and illumination system according to each of Embodiments 1 to 3 is typically implemented as LSI which is an integrated circuit. These may be implemented in a single chip individually, or in a single chip that includes some or all of them.

Moreover, the method of circuit integration is not limited to LSI. Integration may be implemented with a specialized circuit or a general purpose processor. A Field Programmable Gate Array (FPGA) that can be programmed after manufacturing LSI or a reconfigurable processor which allows reconfiguration of the connections and settings of circuit cells inside the LSI may be used.

It should be noted that in Embodiments 1 to 3, each structural component may be configured using dedicated hardware or may be implemented by executing a software program suitable for each structural component. Each structural component may be implemented by a program executing component, such as a CPU or a processor, reading and executing a software programs recorded on a recording medium such as a hard disk or a semiconductor memory.

Moreover, the numbers in the above description are examples used for describing in detail the present disclosure, and the embodiments of the present disclosure are not limited to such numbers.

Moreover, the block diagrams illustrate one example of the division of functional blocks. Functional hocks may be implemented as one functional block, one functional block may be divided into functional blocks, and part of one function may be transferred to another functional block. In addition, functions of functional blocks having similar functions may be processed in parallel or by time-division by a single hardware or software product.

Moreover, the orders in which the steps in the flow charts are executed are examples used for describing in detail the present disclosure, and may include other orders. In addition, some of the steps may be executed at the same time as (in parallel with) the other steps.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A controller that controls an illumination device that emits light illuminating a surrounding area, and an effect-producing device that emits light producing an effect on the surrounding area, wherein the controller is configured to perform at least one of controlling a color of first light emitted by the illumination device so that the color of the first light moves into a specified chromaticity range, and controlling a color of second light emitted by the effect-producing device so that the color of the second light moves into the specified chromaticity range, the color of the first light and the color of the second light being outside of the specified chromaticity range, colors in the specified chromaticity range are recognized as a same color by a human, a plurality of illumination devices are disposed around the effect-producing device, the plurality of illumination devices each being the illumination device, and the controller is configured to control the color of the first light emitted by each of the plurality of illumination devices so that the plurality of illumination devices each have a smaller color difference between the color of the first light and the color of the second light with decreasing distance from the effect-producing device.

2. The controller according to claim 1, wherein the controller is configured to control the color of the first light emitted by the illumination device so that the color of the first light is approximated to the color of the second light.

3. The controller according to claim 1, wherein when the color of the first light and the color of the second light are expressed in CIE xy chromaticity coordinates, the controller is configured to move the color of the first light outside of at least a 3-step MacAdam ellipse that includes, as a center, a position expressed in CIE xy chromaticity coordinates for the color of the first light before being approximated to the color of the second light.

4. The controller according to claim 3, wherein the controller is configured to move the color of the first light into a 3-step MacAdam ellipse that includes, as a center, a position expressed in CIE xy chromaticity coordinates for the color of the second light.

5. The controller according to claim 1, further comprising:

a memory configured to store lighting data indicating the color of the second light emitted by the effect-producing device, wherein the controller is configured to control the color of the first light emitted by the illumination device, according to the lighting data stored in the memory.

6. The controller according to claim 1, further comprising:

a detector configured to detect the color of the second light emitted by the effect-producing device, wherein the controller is configured to control the color of the first light emitted by the illumination device, according to the color of the second light detected by the detector.

7. The controller according to claim 1, wherein the controller is configured to control the color of the second light emitted by the effect-producing device so that the color of the second light is approximated to the color of the first light.

8. A controller that controls an illumination device that emits light illuminating a surrounding area, and an effect-producing device that emits light producing an effect on the surrounding area, wherein the controller is configured to perform at least one of controlling a color of first light emitted by the illumination device so that the color of the first light moves into a specified chromaticity range, and controlling a color of second light emitted by the effect-producing device so that the color of the second light moves into the specified chromaticity range, the color of the first light and the color of the second light being outside of the specified chromaticity range, colors in the specified chromaticity range are recognized as a same color by a human, the controller is configured to control the color of the second light emitted by the effect-producing device so that the color of the second light is approximated to the color of the first light, and when the color of the first light and the color of the second light are expressed in CIE xy chromaticity coordinates, the controller is configured to move the color of the second light outside of at least a 3-step MacAdam ellipse that includes, as a center, a position expressed in CIE xy chromaticity coordinates for the color of the second light before being approximated to the color of the first light.

9. The controller according to claim 8, wherein the controller is configured to move the color of the second light into a 3-step MacAdam ellipse that includes, as a center, a position expressed in CIE xy chromaticity coordinates for the color of the first light.

10. The controller according to claim 1, further comprising:

a memory configured to store lighting data indicating the color of the first light emitted by the illumination device, wherein the controller is configured to control the color of the second light emitted by the effect-producing device, according to the lighting data stored in the memory.

11. The controller according to claim 1, further comprising:

a detector configured to detect the color of the first light emitted by the illumination device, wherein the controller is configured to control the color of the second light emitted by the effect-producing device, according to the color of the first light detected by the detector.

12. The controller according to claim 2, wherein the controller is configured to move, along a black body locus, the color of the first light emitted by the illumination device so that the color of the first light is approximated to the color of the second light.

13. The controller according to claim 7, wherein the controller is configured to move, along a black body locus, the color of the second light emitted by the effect-producing device so that the color of the second light is approximated to the color of the first light.

14. A lighting device, comprising:

the controller according to claim 1; and a light source that emits light, serving as the illumination device or the effect-producing device.

15. The lighting device according to claim 14, further comprising:

a board; and a plurality of light-emitting elements that are arranged in a matrix on the board.

16. An illumination system, comprising:

an illumination device;

an effect-producing device; and the controller according to claim 1 that controls the illumination device and the effect-producing device.

17. A controller that controls an illumination device that illuminates a surrounding area and emits first light having a first color, and an effect-producing device that emits light producing an effect on the surrounding area and emits second light having a second color, wherein the controller is configured to control at least one of the illumination device and the effect-producing device to adjust at least one of the first light and the second light, before adjustment by the controller, the first light has a first initial color having a first n-step MacAdam ellipse, and the second light has a second initial color having a second n-step MacAdam ellipse, n being 1, 2, 3 or 4, when the first initial light is not within the second n-step MacAdam ellipse and the second initial light is not within the first n-step MacAdam ellipse, the controller is configured adjust at least one of the first initial light and the second initial light such that a first adjusted light after the adjustment is within a second n-step MacAdam ellipse after the adjustment or a second adjusted light is within a first n-step MacAdam ellipse after the adjustment.

18. A controller that controls an illumination device that illuminates a surrounding area, and an effect-producing device that emits light producing an effect on the surrounding area, wherein when a first color of first light emitted by the illumination device and a second color of second light emitted by the effect-producing device are expressed in CIE xy chromaticity coordinates, and when at least a 3-step MacAdam ellipse of the second color of the second light is outside of at least a 3-step MacAdam ellipse of the first color of the first light, the controller is configured to cause the first color of the first light to move to outside of the at least 3-step MacAdam ellipse that includes, as a center, a position expressed in CIE xy chromaticity coordinates for the first color of the first light before being approximated to the second color of the second light.

19. A controller that controls an illumination device that illuminates a surrounding area, and an effect-producing device that emits light producing an effect on the surrounding area, wherein when a first color of first light emitted by the illumination device and a second color of second light emitted by the effect-producing device are expressed in CIE xy chromaticity coordinates, and when at least a 3-step MacAdam ellipse of the second color of the second light is outside of at least a 3-step MacAdam ellipse of the first color of the first light, the controller is configured to cause the first color of the first light to move into the at least 3-step MacAdam ellipse that includes, as a center, a position expressed in CIE xy chromaticity coordinates for the second color of the second light before being approximated to the second color of the second light.

20. A controller that controls an illumination device that illuminates a surrounding area, and an effect-producing device that emits light producing an effect on the surrounding area, wherein when a first color of first light emitted by the illumination device and a second color of second light emitted by the effect-producing device are expressed in CIE xy chromaticity coordinates, and when at least a 3-step MacAdam ellipse of the first color of the first light is outside of at least a 3-step MacAdam ellipse of the second color of the second light, the controller is configured to cause the second color of the second light to move to outside of the at least 3-step MacAdam ellipse that includes, as a center, a position expressed in CIE xy chromaticity coordinates for the second color of the second light before being approximated to the first color of the first light.

21. A controller that controls an illumination device that illuminates a surrounding area, and an effect-producing device that emits light producing an effect on the surrounding area, wherein when a first color of first light emitted by the illumination device and a second color of second light emitted by the effect-producing device are expressed in CIE xy chromaticity coordinates, and when at least a 3-step MacAdam ellipse of the second color of the second light is outside of at least a 3-step MacAdam ellipse of the first color of the first light, the controller is configured to cause the second color of the second light to move into the at least 3-step MacAdam ellipse that includes, as a center, a position expressed in CIE xy chromaticity coordinates for the first color of the first light before being approximated to the first color of the first light.

* * * * *